US006953210B2

(12) United States Patent
Lemettinen

(10) Patent No.: US 6,953,210 B2
(45) Date of Patent: Oct. 11, 2005

(54) SOLENOID ARRANGEMENT FOR CONTROLLING HANDLE OPERATION IN A DOOR LOCK

(75) Inventor: Jaakko Lemettinen, Joensuu (FI)

(73) Assignee: Abloy Oy, Joensuu (FI)

( * ) Notice: Subject to any disclaimer, the term of this patent is extended or adjusted under 35 U.S.C. 154(b) by 49 days.

(21) Appl. No.: 10/451,006

(22) PCT Filed: Jan. 17, 2002

(86) PCT No.: PCT/FI02/00037

§ 371 (c)(1),
(2), (4) Date: Jun. 18, 2003

(87) PCT Pub. No.: WO02/059441

PCT Pub. Date: Aug. 1, 2002

(65) Prior Publication Data

US 2004/0061339 A1 Apr. 1, 2004

(30) Foreign Application Priority Data

Jan. 24, 2001 (FI) ..... 20010140

(51) Int. Cl.[7] ..... E05B 15/00

(52) U.S. Cl. ..... 292/244; 292/144; 292/169.14; 292/245; 292/336.3; 70/283

(58) Field of Search ..... 70/462, 283; 292/336.3, 292/144, DIG. 30, DIG. 60, 244, 245, DIG. 27, 169.14–169.18

(56) References Cited

U.S. PATENT DOCUMENTS 3,361,462 A * 1/1968 Foster ..... 292/165
3,792,888 A * 2/1974 Kambic ..... 292/173
3,811,717 A * 5/1974 Floyd et al. ..... 292/92
4,237,711 A * 12/1980 Kambic ..... 70/150
4,390,197 A 6/1983 Butts
4,429,556 A 2/1984 Kambic
4,641,867 A * 2/1987 Geringer et al. ..... 292/336.3
4,656,850 A * 4/1987 Tabata ..... 70/276
4,674,776 A * 6/1987 James ..... 292/40
4,682,799 A * 7/1987 Luker ..... 292/169.15
4,946,207 A * 8/1990 Gillham ..... 292/173
5,074,602 A * 12/1991 Hwang ..... 292/173
5,246,258 A * 9/1993 Kerschenbaum et al. ... 292/144
5,403,047 A * 4/1995 Walls ..... 292/173
5,474,348 A * 12/1995 Palmer et al. ..... 292/359
5,490,699 A * 2/1996 Uyeda ..... 292/341.16
5,876,073 A * 3/1999 Geringer et al. ..... 292/144
5,890,385 A * 4/1999 Lee ..... 70/472
5,953,942 A 9/1999 Doucet et al.
6,082,791 A * 7/2000 Frolov et al. ..... 292/341.16

FOREIGN PATENT DOCUMENTS

GB 2183718 6/1987
WO 96/22438 7/1996

* cited by examiner

*Primary Examiner*—Daniel P. Stodola
*Assistant Examiner*—Carlos Lugo
(74) *Attorney, Agent, or Firm*—Smith-Hill and Bedell

(57) ABSTRACT

A solenoid arrangement for controlling handle operation in a door lock, in which force transmission from an operation axis of a handle or the like to a follower acting on a bolt of the lock is provided by a movable coupling member which receives its guidance from the solenoid arrangement. The arrangement includes a shaft element which is arranged to move through a solenoid against the force of a spring and which moves a turnable lever member selecting the operating position of said coupling member. The position of the turning axis of the said lever member with regard to the coupling member is arranged to be selectively changed to provide a desired handle operation.

11 Claims, 4 Drawing Sheets

SOLENOID ARRANGEMENT FOR CONTROLLING HANDLE OPERATION IN A DOOR LOCK

Figure 1:
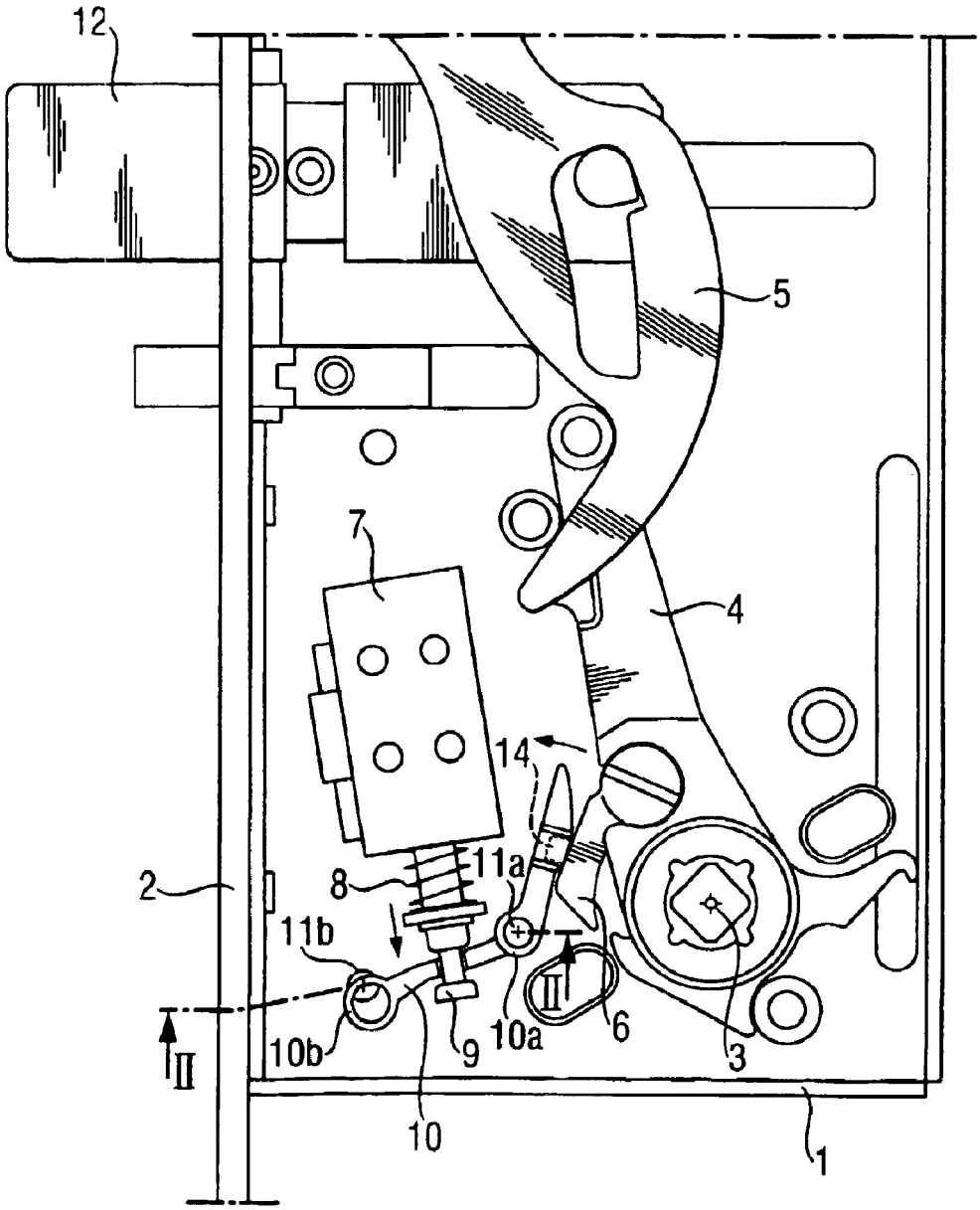

This is a national stage application filed under 35 USC 371 based on International Application No. PCT/FI2002/00037 filed Jan. 17, 2002, and claims priority under 35 USC 119 of Finnish Patent Application No. 20010140 filed Jan. 24, 2001.

The invention related to a solenoid arrangement for controlling handle operation in a door lock, in which force transmission from an operation axis of a handle or the like to a follower acting on a bolt of the lock is arranged by means of a movable coupling member which receives its guidance from the solenoid arrangement.

Control of a handle operation in a door lock by means of a solenoid arrangement can be accomplished in different ways depending on the application. The arrangement may for instance be such that when the solenoid is energized it allows or makes it possible the right to passage by using a handle, whereby, thus, force transmission from the handle to the bolt of the lock is coupled. Alternatively the solution may be reversed so that the arrangement allows the right to passage by using a handle when the solenoid is de-energized. The way of operation of the arrangement depends on whether stress is laid on the security of the right to passage or getting out from the locked space or on the security of the locked space as such. In practice the arrangement is usually such that from outside the door can always be opened by means of a key operated lock mechanism of the like and from inside by means of a handle, a turning knob or the like, whereby selective coupling of the handle operation presumes at the same time a two-piece or divided shaft of operation.

A practical problem included in the arrangements described above is that two separate lock case versions are needed for the door lock, one for each way of operation.

An aim of the invention is to provide a novel solution of the kind in which the same basic parts to be installed in the lock case can be utilized for both the ways of operation described above and in which the selection of the way of operation can be accomplished in a simple way from outside without opening the lock case itself. A further aim is that the arrangement is advantageous as to manufacturing technique and secure as to operation and does not require too much space in the lock case.

According to the invention the arrangement includes a shaft element which is arranged to move through a solenoid against the force of a spring and which moves a turnable lever member selecting the operating position of said coupling member. In addition the position of the turning axis of the said lever member with regard to the coupling member is arranged to be selectively changed to provide a desired handle operation. The solution is thus essentially based on the fact that the turning axis of the lever member to be used can be located in different places and the place can easily be changed if needed.

In a practical embodiment of advantage the lever member is supported to the shaft element so that the position of the turning axis of the lever member can be changed from one side of the shaft element to the other, whereby certain movement of the shaft element provides turning of the head of the lever member in different direction with regard to the coupling member.

A compact arrangement is accomplished if the turning axis of the lever member is parallel with said operation axis. In this case the arrangement may with advantage include a selecting member installed outside the lock case of the door lock, comprising a stub shaft which can be inserted inside the lock case so that it is in cooperation with the lever member and serves as its turning axis in each case.

A solution advantageous from the viewpoint of utilization of space and security is accomplished in case the lever member includes two sleeve-like elements for said stub shaft so that one of the sleeve-like elements is located on the end of the lever member opposite with regard to the coupling member.

Changing of the location of the turning axis of the lever member can be accomplished in a simple way by changing the position or set of the selecting member. After selecting the desired way of operation the selecting member can with advantage be fixed to the lock case by means of a screw or the like.

In one embodiment of the invention the end of the lever member close to the coupling member is provided with a magnet for attracting the coupling member.

Figure 2:
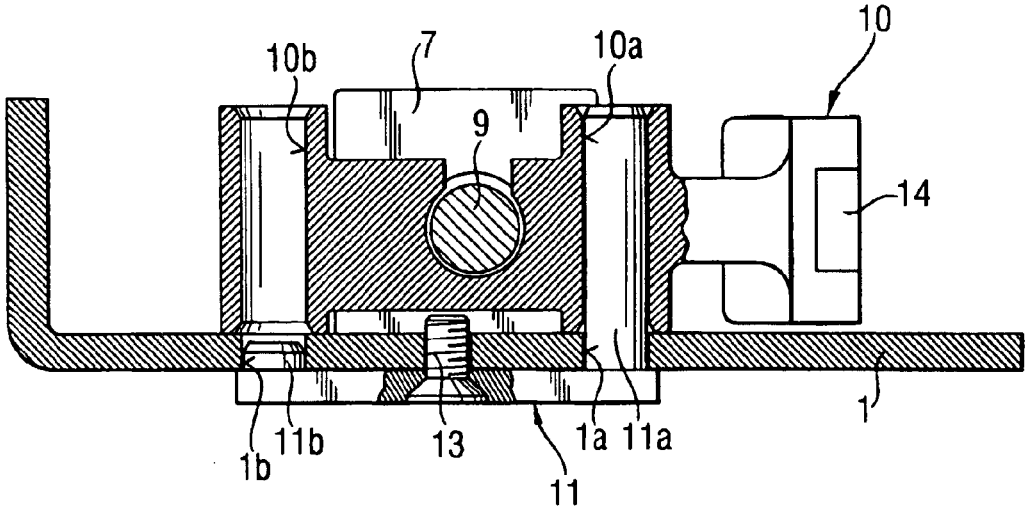
Figure 3:
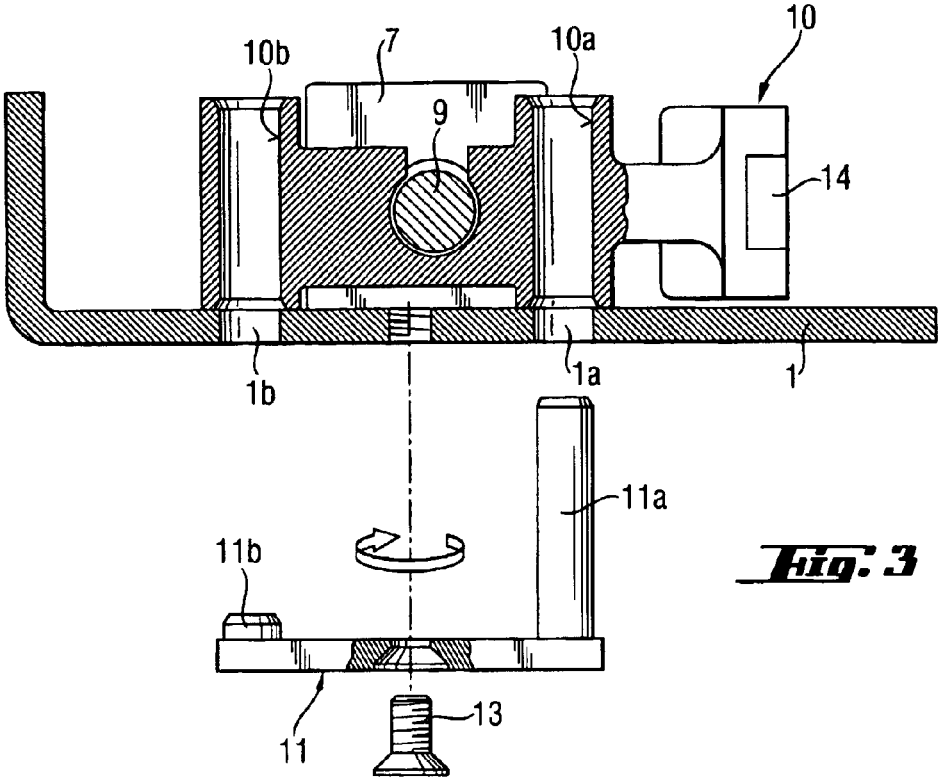
Figure 4:
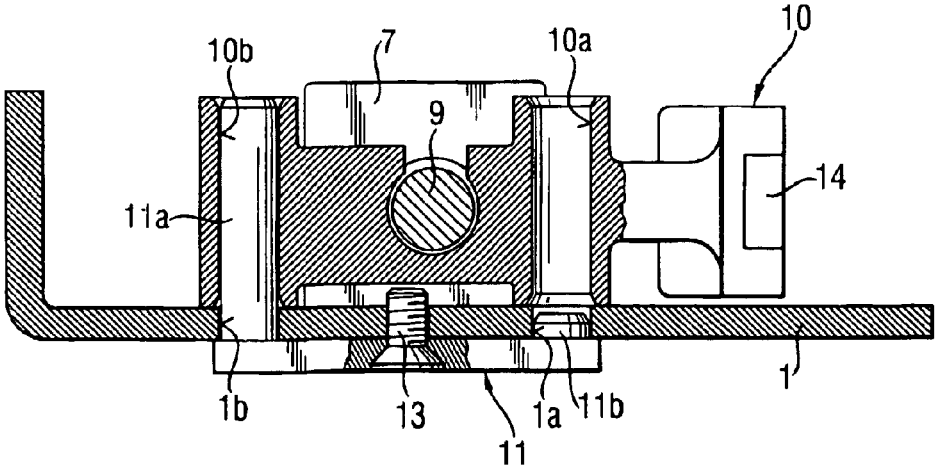
Figure 5:
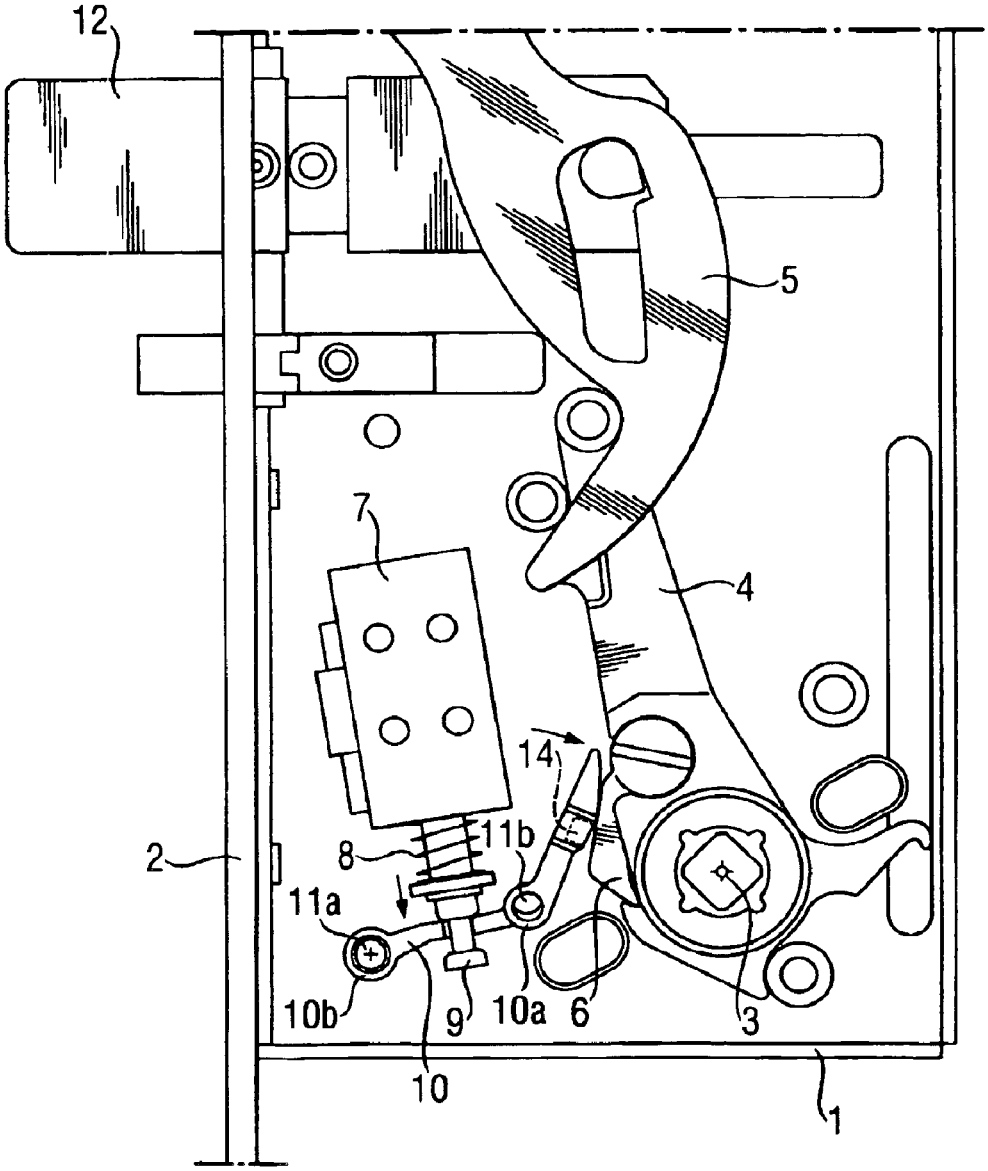

In the following the invention is described by way of example with reference to the attached drawings in which FIG. 1 shows an embodiment of a solenoid arrangement for a door lock according to the invention as a side view and the lock case opened, FIG. 2 shows section II—II of FIG. 1 as an enlargement, FIGS. 3 and 4 illustrate selection of the way of operation of a handle as a sectional view corresponding to FIG. 2, FIG. 5 shows the embodiment of FIG. 2 after providing a change of the way of operation of a handle.

In the drawings the reference numeral 1 indicates a lock case of a door lock having a cover which in the figures is shown partly opened. The lock case 1 is provided with a front plate 2 through which a bolt 12 of the lock is movable. The lock case 1 is additionally provided with an operation axis 3, to which is installed a follower 4 which is turnably journalled to the lock case and which in the embodiment shown acts on the bolt of the lock through a separate force transmission lever 5. Naturally, when desired the follower can be arranged to move the bolt of the lock also directly.

In practice the follower 4 can be affected from both sides of the lock. A key operated lock mechanism or the like, which is provided with a torsion arm or a corresponding force transmission element (not shown) acting directly on the follower 4, is installed on the operation axis 3 on one side of the lock case in a way known as such. Alternatively, depending on the situation also a handle or the like may be installed so that its spindle extends to and acts directly on the follower 4. Hereby the door can always be opened from this side. On the other side of the lock case a handle, a turn knob or the like is installed on the operation axis 3, a not-shown spindle of which is independent on the said force transmission element of the lock mechanism or said alternative handle arrangement so that the handle operation can correspondingly be controlled independently. The force transmission required by the handle operation is arranged by means of a coupling member 6, which has two selectable operating positions, a force transmission coupling position, in which the bolt of the lock can be moved by means of the handle, and a force transmission decoupling position, in which the bolt of the lock correspondingly cannot be affected by means of the handle.

Control of the handle operation occurs with an arrangement according to the invention, including a solenoid 7, which moves a shaft element 9 against the force of a spring 8. Arranged on the shaft element 9 there is a lever member 10 which acts on the coupling member 6 so that by means of it, it is possible to select whether or not the coupling member 6 is in its position connecting the force transmission.

The lever member 10 is provided with sleeve elements 10*a* and 10*b*, which are located on different sides of the shaft element 9. The arrangement includes also a selecting member 11 to be fixed by means of a screw 13 outside to the lock case 1 and which is provided with a long stub shaft 11*a* and a short stub shaft 11*b*. The selecting member 11 can be arranged in cooperation with the lever member 10 so that the long stub shaft 11*a* is located in either one of the sleeve elements 10*a* and 10*b*. The lock case 1 has apertures 1*a* and 1*b* for the stub shafts 11*a* and 11*b*.

In the situation of FIGS. 1 and 2 the solenoid 7 is not powered, whereby the spring 8 presses the shaft element 9 in the direction of the arrow. Due to this the lever member 10 is turned through its sleeve element 10*a* around the long stub shaft 11*a* of the selecting member 11 in the counter clock-wise direction as indicated in FIG. 1. The lever member 10 is in this case provided with a magnet 14, which attracts the coupling member 6 into a non-coupling position, whereby a handle installed to the operation axis 3 is not in force transmission connection with the follower 4 and thus with the bolt of the lock either. Instead of the magnet 14, when desired, the follower 6 may also be moved by means of spring force.

Correspondingly when power is connected to the solenoid 7 it moves the shaft element 9 against the force of the spring 8, whereby the lever member 10 turns in the clockwise direction and presses the coupling member 6 into its coupling position. For the matter of simplicity there is no disclosure of power supply in the figures.

The FIGS. 3 and 4 illustrate how control of the handle operation can be changed by changing the position of the selecting member 11. This is simply carried out so that the screw 13 is detached and the selecting member 11 is turned half a turn, so that the position of the stub shafts 11*a* and 11*b* in the apertures 1*a* and 1*b* is changed. In this situation the long stub shaft 11*a* is located in the sleeve element 10*b*. As a consequence of this, in the way shown in FIG. 5, when the solenoid 7 is without power and the spring 8 is pressing the shaft element 9 in the direction of the arrow the lever member 10 is turned through its sleeve element 10*b* in the clock-wise direction as indicated by the arrow, whereby at the same time it presses the coupling member 6 into its coupling position. Hereby a handle installed to the operation axis 3 is in force transmission connection with the follower 4 and it is possible to operate the bolt of the lock with it. If power is connected to the solenoid 7 in this situation, the direction of the movements of the different members are changed and the coupling member 6 moves because of the magnet 14 into its non-coupling position.

The invention is not limited to the embodiment shown, but several modifications are feasible within the scope of the attached claims.

What is claimed is:

1. A door lock comprising:

a lock case, a bolt, a follower acting on the bolt, a coupling member selectively movable relative to the follower between a coupling position in which the coupling member coupled an operating shaft of the lock to the follower for force transmission from the operating shaft to the follower, and a decoupling position in which the operating shaft is not coupled to the follower, a lever member that includes a first support element and a second support element at different respective distances from the coupling member, a pivot member for engaging selectively either said first support element or said second support element and supporting the lever member for turning movement relative to the lock case about a central axis of the pivot member in a first rotational direction for moving the coupling member to the coupling position and in a second rotational direction, opposite the first rotational direction, for permitting the coupling member to move to the decoupling position, and an actuator including an engagement element that engages the lever member at a location between the first and second support elements and a force mechanism for urging the engagement element in a first direction for turning the lever member in one of said first and second rotational directions about the central axis of the pivot member or in a second direction, opposite the first direction, for turning the lever member in the other of said first and second rotational directions about the central axis of the pivot member, whereby in the event that the pivot member engages the first support element, urging of the engagement element in the first direction causes the lever member to turn in the first rotational direction whereas in the event that the pivot member engages the second support element, urging of the engagement element in the first direction causes the lever member to turn in the second rotational direction.

2. A door lock according to claim 1, wherein the central axis of the pivot member is parallel to the operating shaft.

3. A door lock according to claim 1, wherein the first and second support elements comprise respective sleeve elements and the pivot member comprises a stub shaft that projects into the lock case and engages the first or second support element.

4. A door lock according to claim 1, wherein the lock casing is formed with first and second mounting apertures and the pivot member engages the first support element when installed in the first mounting aperture and engages the second support element when installed in the second mounting aperture.

5. A door lock according to claim 1, wherein the lever member has first and second opposite ends, the first end of the lever member engages the coupling member and the second support element is provided at the second end of the lever member.

6. A door lock according to claim 1, wherein the pivot member is part of a selecting member that can be installed so that it engages the lock case in either of first and second positions and in the first position of the selecting member the pivot member engages the first support element whereas in the second position of the selecting member the pivot member engages the second support element.

7. A door lock according to claim 6, comprising a fastening element that secures the selecting member to the lock case.

8. A door lock according to claim 1, wherein the lever member has an end for engaging the coupling member and the lever member comprises a magnet for attracting the coupling member to the decoupling position when the lever member turns in the second rotational direction.

9. A door lock according to claim 1, wherein the force mechanism comprises a solenoid and the engagement element comprises a shaft element that is urged in the second direction when the solenoid is energized.

10. A door lock according to claim 9, wherein the force mechanism further comprises a spring that urges the shaft element in the first direction.

11. A method of adjusting a door lock that comprises a lock case, a bolt, a follower adjusting on the bolt, a coupling member selectively movable relative to the follower between a coupling position in which the coupling member couples an operating shaft of the lock to the follower for force transmission from the operating shaft to the follower, and a decoupling position in which the operating shaft is not coupled to the follower, a lever member that includes a first support element and a second support element at different respective distances from the coupling member, a pivot member that is installed in the lock so that it engages said first support element and supports the lever member for turning movement relative to the lock case about the pivot member in a first rotational direction for moving the coupling member to the coupling position and in a second rotational direction, opposite the first rotational direction, for permitting the coupling member to move to the decoupling position, and an actuator including an engagement element that engages the lever member at a location between the first and second support elements and a force mechanism for urging the engagement element in a first direction for turning the lever member in the first rotational direction about the pivot member or in a second direction, opposite the first direction, for turning the lever member in the second rotational direction about the pivot member, said method comprising:

disengaging the pivot member from the first support element of the lever member, and installing the pivot member in the lock so that the installed pivot member engages the second support elements and supports the lever member for turning movement relative to the lock case.

* * * * *